United States Patent [19]

Sheridan

[11] Patent Number: 4,809,941

[45] Date of Patent: Mar. 7, 1989

[54] SHELF BRACKET

[76] Inventor: Jackson C. Sheridan, 10454 Cliota, Whittier, Calif. 90601

[21] Appl. No.: 145,578

[22] Filed: Jan. 19, 1988

[51] Int. Cl.[4] ..... E04G 3/08

[52] U.S. Cl. ..... 248/249; 248/235; 248/250; 248/302

[58] Field of Search ..... 248/249, 250, 247, 302, 248/235, 300; 211/186; 108/152, 47

[56] References Cited

U.S. PATENT DOCUMENTS

| | | | |
|---|---|---|---|
| 2,954,125 | 9/1960 | Husted | 248/249 X |
| 3,153,526 | 10/1964 | Pawsey | 248/302 X |
| 3,279,620 | 10/1966 | Nesbitt | 248/302 X |
| 3,288,414 | 11/1966 | Fortunato | 248/302 X |
| 3,393,888 | 7/1968 | Henningsgard | 248/302 X |
| 4,269,381 | 5/1981 | Harms | 248/249 X |

*Primary Examiner*—Ramon O. Ramirez

*Attorney, Agent, or Firm*—Edgar W. Averill, Jr.

[57] ABSTRACT

A bracket assembly for supporting a shelf or other article. A rectangular support beam is affixed to a wall, or other upright, and a bracket holding member is held by the support beam. A bracket is held to the support beam by the bracket holding member. Preferably, the bracket holding member and the bracket are fabricated from heavy wire such as wire having an outside diameter of about a quarter of an inch.

14 Claims, 2 Drawing Sheets

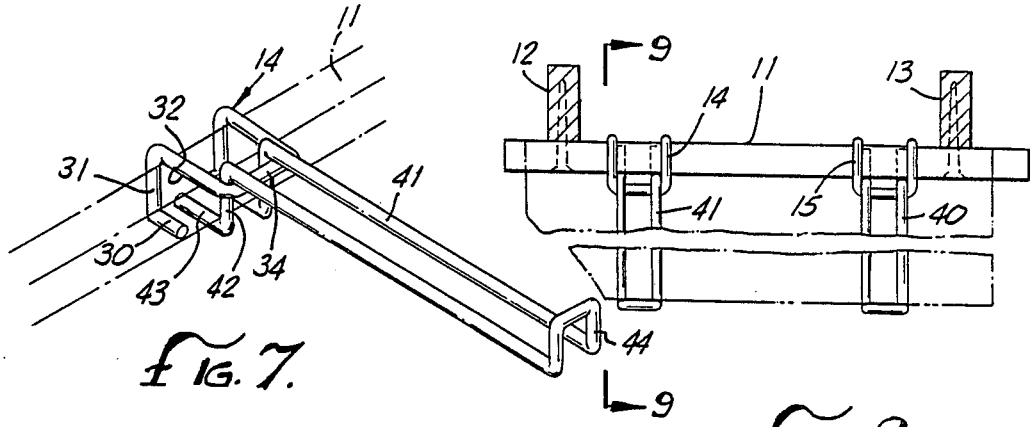
FIG. 7.
FIG. 8.
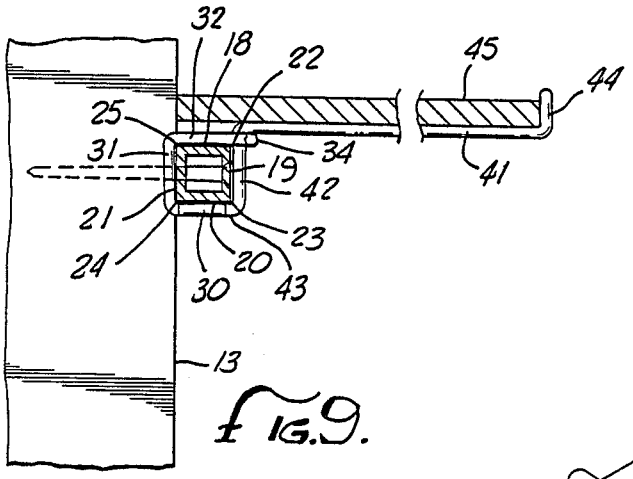
FIG. 9.
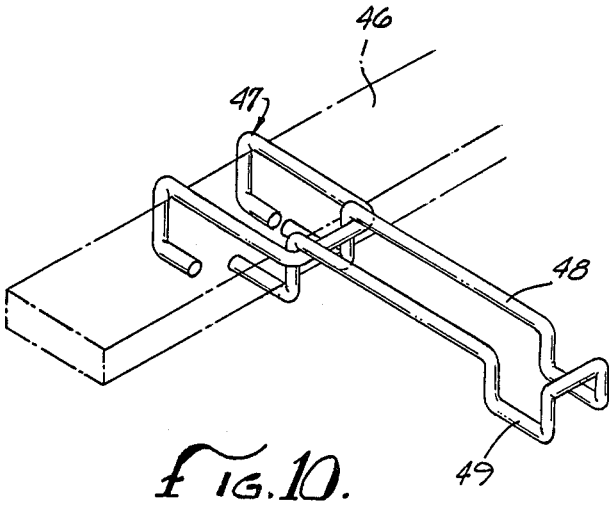
FIG. 10.
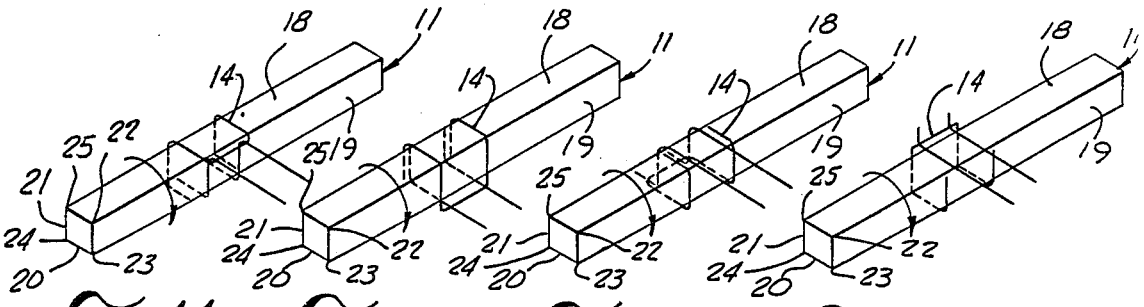
FIG. 11. FIG. 12. FIG. 13. FIG. 14.

SHELF BRACKET

BACKGROUND OF THE INVENTION

The field of the invention is hardware and the invention relates more particularly to shelf brackets.

Various means for supporting shelves on a wall, or along a series of vertical studs or other members, are known. Typically, a series of brackets are screwed or otherwise affixed to the wall and the brackets extend outwardly from the wall. Some types of shelf brackets are supported by vertical members which have a plurality of vertical slots and the brackets are inserted into such slots. A shelf bracket of that general type is shown in U.S. Pat. No. 2,833,420.

SUMMARY OF THE INVENTION

It is an object of the present invention to provide a shelf bracket assembly which is inexpensive to manufacture and easy to install.

The present invention is for a bracket assembly for supporting a shelf or other article. The bracket assembly comprises a horizontal, rectangular support beam which is affixed to at least one upright member. The rectangular support beam has a top, a bottom, a front and a back and four corners therebetween. A bracket holding member is placed over the support beam and overlies at least three surfaces of the support beam. The bracket holding member has a first surface, an intermediate surface and a loop surface, and the loop surface extends over one of the four corners thereby forming a slot. The bracket holding member is positioned over the beam so that when the beam is viewed from a longitudinal end so that the shelf, or other article, is extending to the right, the progression from the first, intermediate and loop surfaces of the bracket holding member is in a clockwise direction. A bracket member extends through the slot and has a beam-contacting length which extends over at least the one surface of the beam which is not overlaid by the first, intermediate and loop surfaces of the bracket holding member. The article-supporting surface of the bracket member extends outwardly through the slot. In one of two preferred embodiments, the bracket holding member extends over the corner between the front and bottom of the support beam. In another preferred configuration, the loop extends over the corner between the top and front of the support beam, and the bracket member extends downwardly over the front surface of the support beam and outwardly away from the loop. Preferably, the bracket and bracket holding members are formed from heavy wire such as wire having an outside diameter of about one-quarter of an inch. Further, preferably, the support beam is square.

BRIEF DESCRIPTION OF THE DRAWINGS

FIG. 7 is a perspective view of an alternate embodiment of bracket holding member and bracket.

FIG. 8 is a top view of the support beam, bracket holding member and bracket of the type shown in FIG. 7.

FIG. 9 is a cross-sectional view taken along line 9—9 of FIG. 8.

FIG. 10 is a perspective view of an alternate embodiment of bracket holding member and bracket member of FIG. 7.

FIG. 11 is a schematic view of a support beam, bracket holding member and bracket of the present invention.

FIG. 12 is a schematic view of a support beam, bracket holding member and bracket of the present invention.

FIG. 13 is a schematic view of a support beam, bracket holding member and bracket of the present invention.

FIG. 14 is a schematic view of a support beam, bracket holding member and bracket of the present invention.

DESCRIPTION OF THE PREFERRED EMBODIMENTS

Figure 1:
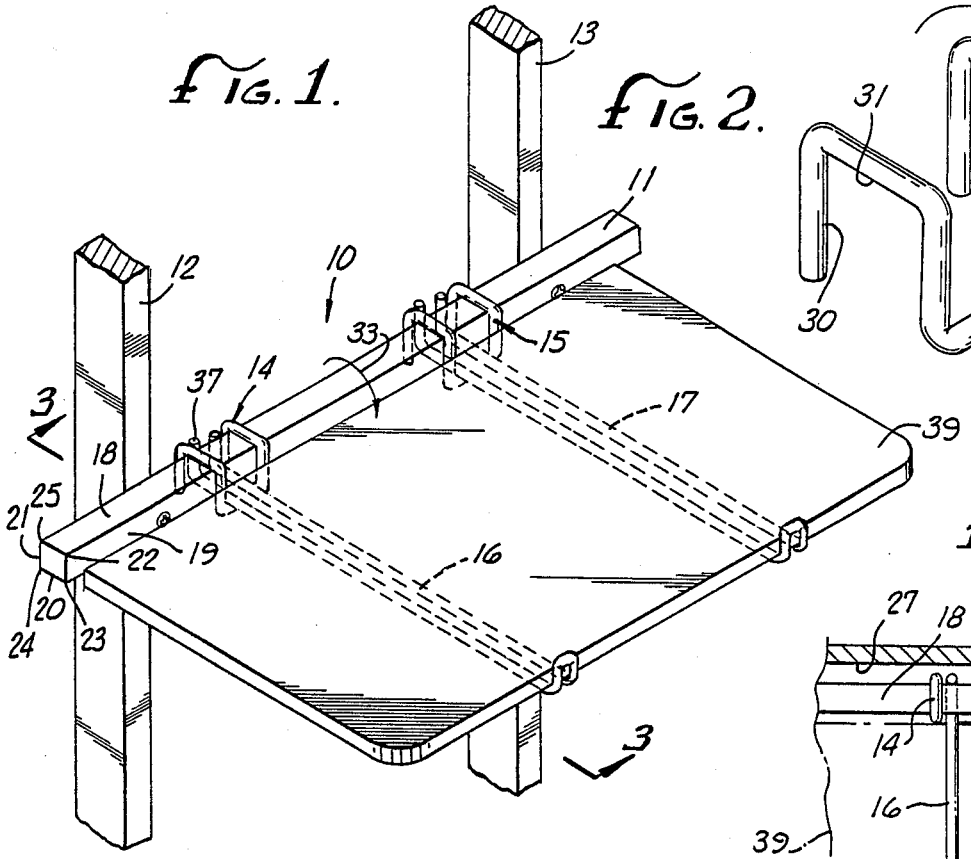
FIG. 1 is a perspective view of the bracket support assembly of the present invention.

The bracket assembly of the present invention is shown in perspective view in FIG. 1 and indicated generally by reference character 10. Bracket assembly 10 consists of three different elements: First, a horizontal, rectangular support beam 11 which is screwed to a pair of vertical studs 12 and 13. Secondly, bracket holding members 14 and 15 surround three surfaces of the rectangular support beam 11, and thirdly, a pair of brackets 16 and 17 are held by the support beam 11 and by bracket holding members 14 and 15, respectively.

Figure 5:
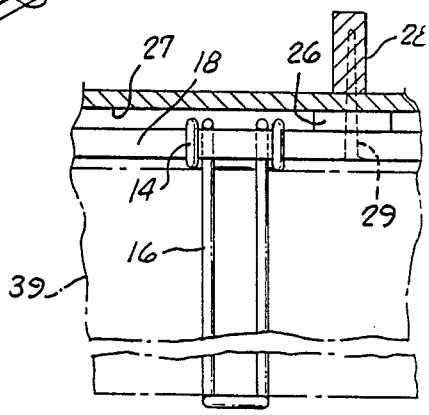
FIG. 5 is a top view of the bracket support assembly and shelf of FIG. 4.
Figure 4:
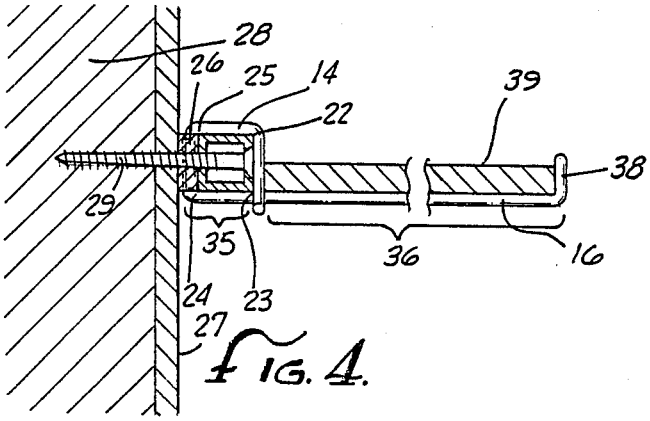
FIG. 4 is a cross-sectional side view of the bracket support assembly of FIG. 1 mounted on a wall.

In more detail, support beam 11 has a top 18, a front 19, a bottom 20 and a back 21. Beam 11 also has four corners 22, 23, 24 and 25. Bracket assembly 10 must be mounted in a way which permits the bracket holding members, such as 14 and 15, to pass over the back 21 of the rectangular support beam 11. If the bracket assembly 10 is mounted on open studs, as shown in FIG. 1, these members may be placed between the studs. If the bracket assembly 10 is mounted on a flat wall surface, as indicated in FIGS. 4 and 5, then spacer members, such as spacer member 26, should be used to hold support beam 11 away from the wallboard 27. Preferably, spacer member 26 should be positioned in front of a stud 28 so that screw 29 is used not only to hold support beam 11, but also spacer member 26.

Figure 2:
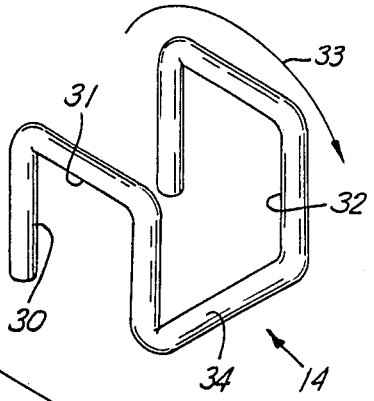
FIG. 2 is an enlarged perspective view of the bracket holding member of the bracket support assembly of FIG. 1.
Figure 3:
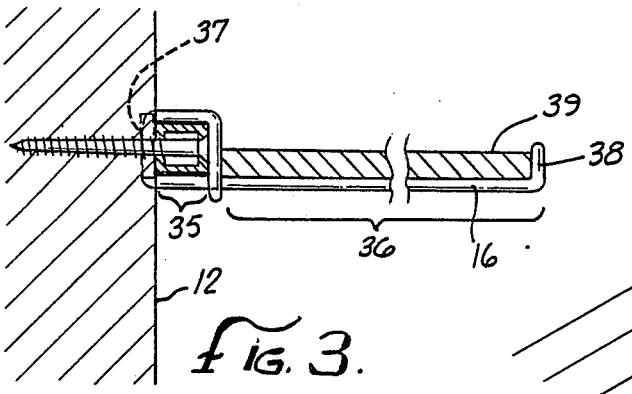
FIG. 3 is a cross-sectional view taken along line 3—3 of FIG. 1.
Figure 6:
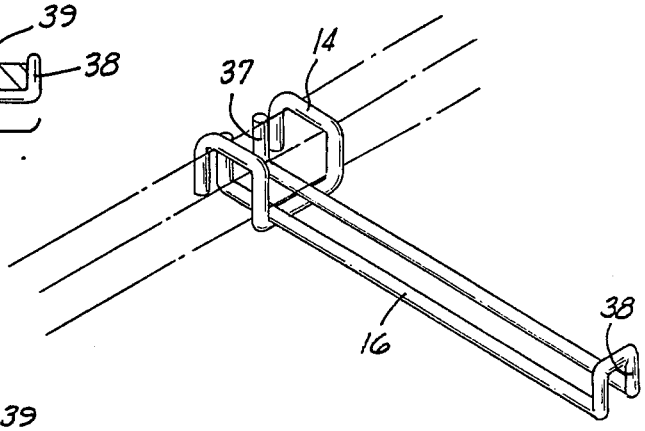
FIG. 6 is a perspective view of the bracket holding member and bracket member of the bracket assembly of FIG. 1.

The bracket holding member 14 is shown in enlarged perspective view in FIG. 2 where it can be seen that holding member 14 has three inner surfaces, namely first surface 30, intermediate surface 31 and loop surface 32. Although, bracket holding member 14 may be oriented in four different positions over support beam 11, it is important that the bracket holding member be oriented so that the loop surface is leading in a clockwise direction when the bracket holding member is viewed as in FIGS. 3 and 4. In these figures, the bracket 16 is extending to the right-hand side in the drawings. Thus, the progression from first surface 30 to intermediate surface 31, to loop surface 32 is clockwise. As shown best in FIGS. 11 through 14, the bracket holding member may be in any of four positions, but all positions show the loop surface leading in a clockwise direction.

In FIGS. 1 through 6, the loop formed by loop edge 34 extends over corner 23 which is located between front edge 19 and bottom edge 20 of the rectangular support beam 11. Bracket 16 extends through the loop formed by loop edge 34 and corner 23. Bracket 16 has a beam-contacting length indicated by reference character 35 in FIGS. 3 and 4 and an article-supporting length 36, also indicated in FIGS. 3 and 4. Beam-contacting length 35 of FIGS. 1 through 6 contacts bottom surface 20 of beam 11. The beam-contacting length 35 terminates in a right-angled portion 37 which abuts the back edge 21 of beam 11. This prevents the outward movement of bracket 16. Preferably, the article-supporting length 36 of bracket 16 terminates in a vertical length 38 which helps to hold shelf 39 in place.

Support beam 11 is preferably hollow to save weight and should be rectangular. In a preferred configuration, beam 11 is square for the reason that such square tubing is widely used and relatively economical. Also, it is preferable that the bracket holding member be formed of heavy wire, such as wire having an outside diameter of about one-quarter of an inch, although somewhat larger wire may be used for heavy duty applications. Similarly, the bracket member, itself, is preferably formed from heavy wire, also having an outside diameter of about one-quarter of an inch. In this way, the members required to form a bracket may be economically formed and easily secured to a wall or a plurality of upright members.

Another configuration of the bracket assembly of the present invention is shown in FIGS. 7 through 10 where bracket holding member 14 is positioned so that loop edge 34 extends over corner 22 which is located between top 18 and front 19 of beam 11. Again, the progression from first surface 30, intermediate surface 31 and loop surface 32 is in a clockwise direction as viewed in FIG. 7 where the shelf bracket 41 extends to the right. Shelf bracket 41 has a downward bend 42 and a rearward bend 43 which, respectively, lie along the front surface 19 and the bottom surface 20. Bracket 41 also has a vertical bend 44 at the end thereof. It can also be seen that shelf 45 is held between vertical bend 44 and stud 13. This provides a particularly secure assembly in that if the bracket were struck from below, it would not tilt upwardly since shelf 45 would prevent such upward movement.

As seen in FIG. 10, it is not necessary that the support beam be square, but any rectangular shape will suffice. Thus, a rectangular beam, shown in phantom lines in FIG. 10 and indicated by reference character 46, is surrounded by a bracket holding member 47 which holds a bracket 48 in a manner similar to that shown in FIG. 7. Bracket 48, rather than holding a shelf, however, has a hook 49 for holding an article such as a bale of a plant basket.

As mentioned briefly above, bracket holding member, such as member 14, can be oriented in any position on beam 11, and in FIG. 11, member 14 has its loop end 34 extending over corner 22. In FIG. 12, loop end 34 extends over corner 23. In FIG. 13, loop end 34, shown in phantom lines, extends over corner 24, and in FIG. 14, loop end 34 extends over corner 25. The bracket member, which is indicated by reference characters 50 through 53, is shaped to cooperate with the bracket holding member. It should be noted in each case, the bracket has a beam-contacting length which covers at least one of the surfaces of beam 11.

The bracket assembly of the present invention is particularly easy to install. The shelf may be readily placed in a horizontal position merely by positioning beam 11 in a horizontal manner. Similarly, the bracket and bracket holding member may be placed at preferred positions since they may be located anywhere along the beam except in the occasional areas where the beam is abutting a stud or a spacer.

While the bracket, such as bracket 16, is shown as fabricated from heavy wire, it could, of course, be formed from a solid, or hollow, bar. Furthermore, while the bracket holding member is preferably fabricated from heavy wire, as shown in the drawings, it, likewise, could be formed from a bent bar with a slot formed near the portion indicated by reference character 34 in FIG. 2. Heavy wire, however, is particularly inexpensive to form and is the preferred configuration of the bracket assembly of the present invention.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A bracket assembly for supporting a shelf or other article, said bracket assembly comprising:

a horizontal, rectangular support beam affixed to at least one upright member, said rectangular support beam having a top, a bottom, a front and a back and four corners therebetween;

a bracket holding member overlying three surfaces of said support beam and having three surfaces, namely, a first surface, an intermediate surface and a loop surface, and said loop surface extending over one of said four corners thereby forming a slot and said bracket holding member being positioned over said beam so that when the beam is viewed from a longitudinal end so that the shelf or other article is extending to the right, the progression from the first, intermediate and loop surfaces is in a clockwise manner; and a bracket member extending through the slot and said bracket member having a beam-contacting length which extends at least over the one surface of the beam which is not overlaid by the first, intermediate and loop surfaces of said bracket holding member and an article-supporting length which extends outwardly through said slot, said article-supporting length terminating in an outer end.

2. The bracket assembly of claim 1 wherein said bracket holding member extends over the corner between the front and the bottom of the support beam.

3. The bracket assembly of claim 2 wherein said bracket member is horizontal and has an upward vertical bend at the outer end thereof and said bracket further supports a shelf extending from the bracket holding member to the vertical bend.

4. The bracket assembly of claim 1 wherein said bracket member is formed from heavy wire.

5. The bracket assembly of claim 1 wherein said holding member is formed from heavy wire.

6. The bracket assembly of claim 1 wherein said bracket holding member extends over the corner between the top and the front of the support beam and said bracket member extends downwardly over the front surface and rearwardly over at least a portion of the bottom surface.

7. The bracket assembly of claim 1 wherein said rectangular support beam has a square cross-sectional shape.

8. A bracket assembly for supporting a shelf or other article, said bracket assembly comprising:

a horizontal, rectangular support beam affixed to at least one upright member, said rectangular support beam having a top, a bottom, a front and a back and four corners therebetween;

a bracket holding member overlying the back, top and front surfaces of said support beam and having three surfaces, namely, a first surface, an intermediate surface and a loop surface, and said loop surface extending over the corner between the front and bottom surfaces thereby forming a slot, and said bracket holding member being positioned over said beam so that when the beam is viewed from a longitudinal end so that the shelf or other article is extending to the right, the progression from the first, intermediate and loop surfaces is in a clockwise manner; and a bracket member extending through the slot and said bracket member having a beam-contacting length which extends over the bottom surface of the beam and extends over at least a portion of the back surface of the beam and an article-supporting length which extends outwardly through said slot and ends at a bracket member terminus.

9. The bracket assembly of claim 8 wherein the terminus of the bracket member is turned upwardly.

10. The bracket assembly of claim 9 further including a shelf extending from the bracket holding member to the terminus of the bracket holding member.

11. A bracket assembly for supporting a shelf or other article, said bracket assembly comprising:

a horizontal, rectangular support beam affixed to at least one upright member, said rectangular support beam having a top, a bottom, a front and a back and four corners therebetween;

a bracket holding member overlying the bottom, back and top surfaces of said support beam and having three surfaces, namely, a first surface, an intermediate surface and a loop surface and said loop surface extending over the corner between the top surface and front surface thereby forming a slot and said bracket holding member being positioned over said beam so that when the beam is viewed from a longitudinal end so that the shelf or other article is extending to the right, the progression from the first, intermediate and loop surfaces is in a clockwise manner; and a bracket member extending through the slot and said bracket member having a beam-contacting length which extends downwardly over the front surface of the beam and further extends over at least a portion of the bottom of the beam and an article-supporting length which extends outwardly through said slot and ends at a bracket member terminus.

12. The bracket assembly of claim 11 wherein the terminus of the bracket member is turned upwardly.

13. The bracket assembly of claim 11 further including a shelf extending from the at least one upright member to the terminus of the bracket holding member.

14. The bracket assembly of claim 11 wherein said support beam has a square cross-sectional shape.

* * * * *